US005820422A

United States Patent [19]

Chadbourne et al.

[11] Patent Number: 5,820,422

[45] Date of Patent: Oct. 13, 1998

[54] COVER FOR AN ELECTRICAL WEDGE CONNECTOR

[75] Inventors: Richard Chadbourne, Merrimack; Armand T. Montminy, Manchester, both of N.H.

[73] Assignee: Framatome Connectors USA Inc., Norwalk, Conn.

[21] Appl. No.: 889,416

[22] Filed: Jul. 8, 1997

[51] Int. Cl.[6] ..... H01R 11/09

[52] U.S. Cl. ..... 439/783; 24/543; 24/136 L

[58] Field of Search ..... 439/783, 521, 439/369, 367; 24/543, 346, 136 L; 174/76; 220/4.02, 4.23, 324, 339

[56] References Cited

U.S. PATENT DOCUMENTS

| | | | |
|---|---|---|---|
| 3,344,393 | 9/1967 | Hendee | 439/369 |
| 4,234,080 | 11/1980 | Gellert | 220/4.23 |
| 5,135,409 | 8/1992 | Thompson | 439/367 |
| 5,363,539 | 11/1994 | Tisol | 24/543 |
| 5,410,105 | 4/1995 | Tahara et al. | 174/76 |
| 5,507,671 | 4/1996 | Chadbourne et al. | 439/783 |
| 5,569,882 | 10/1996 | Yikoyama et al. | 174/76 |

FOREIGN PATENT DOCUMENTS

WO 96/21964 7/1996 WIPO .

*Primary Examiner*—Neil Abrams
*Assistant Examiner*—T. C. Patel
*Attorney, Agent, or Firm*—Perman & Green, LLP

[57] ABSTRACT

A one-piece electrical wedge connector cover having a base section and two flap sections hinged to the base section. The base section has tow posts. A first one of the flap sections has two snap-lock latches. A second one of the flap sections has two holes. The latches pass through the holes and attach to the posts. The posts prevent an electrical wedge connector from being pulled out of the cover.

18 Claims, 4 Drawing Sheets

COVER FOR AN ELECTRICAL WEDGE CONNECTOR

BACKGROUND OF THE INVENTION

1. Field Of The Invention

The present invention relates to electrical connectors and, more particularly, to a cover for an electrical wedge connector.

2. Prior Art

The Burndy Electrical division of Framatome Connectors USA Inc. sells covers for wedge connectors under the trademark WEJTAP. PCT publication No. WO 96/21964 discloses a cover for an electrical wedge connector. The cover, because of its shape, has a limited use with specific size wedge connectors. In practice, AMP Inc. which sells covers corresponding to this PCT publication has four different sizes of covers for covering seven different size wedge connectors. It is desired to provide an electrical wedge connector that can cover more sizes of wedge connector and, therefore, reduce the inventory of different covers.

SUMMARY OF THE INVENTION

In accordance with one embodiment of the present invention an electrical wedge connector cover is provided comprising a first section and a second section. The first section has a first post. The second section is movably attached to the first section. The first and second sections have a closed position to form a wedge connector holding area therebetween. The post extends across a width of the holding area at a first end of the holding area to prevent withdrawal of the wedge connector out of the cover through the first end. The post allows electrical conductors to pass out of the cover on opposite sides of the post.

In accordance with another embodiment of the present invention, an electrical wedge connector cover is provided comprising a base section, a first flap section, and a second flap section. The first flap section is connected to the base section by a first hinge section. The second flap section is connected to the base section at an opposite side relative to the first flap section by a second hinge section. The first and second flap sections are pivoted in reverse directions over the base section. The first and second flap sections are connected to each other to form a wedge connector holding area.

In accordance with another embodiment of the present invention an electrical wedge connector cover is provided comprising a base section and a first flap section. The base section has two posts. The first flap section is movably attached to the base section. The first flap section has two snap-lock latches. When the flap section is moved to a closed position to form a wedge connector holding area with the base section, the snap-lock latches attach to the posts to stationarily locate the flap section with the base section. The posts span the width of the holding area at opposite ends of the holding area to prevent the wedge connector from being withdrawn from the cover.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
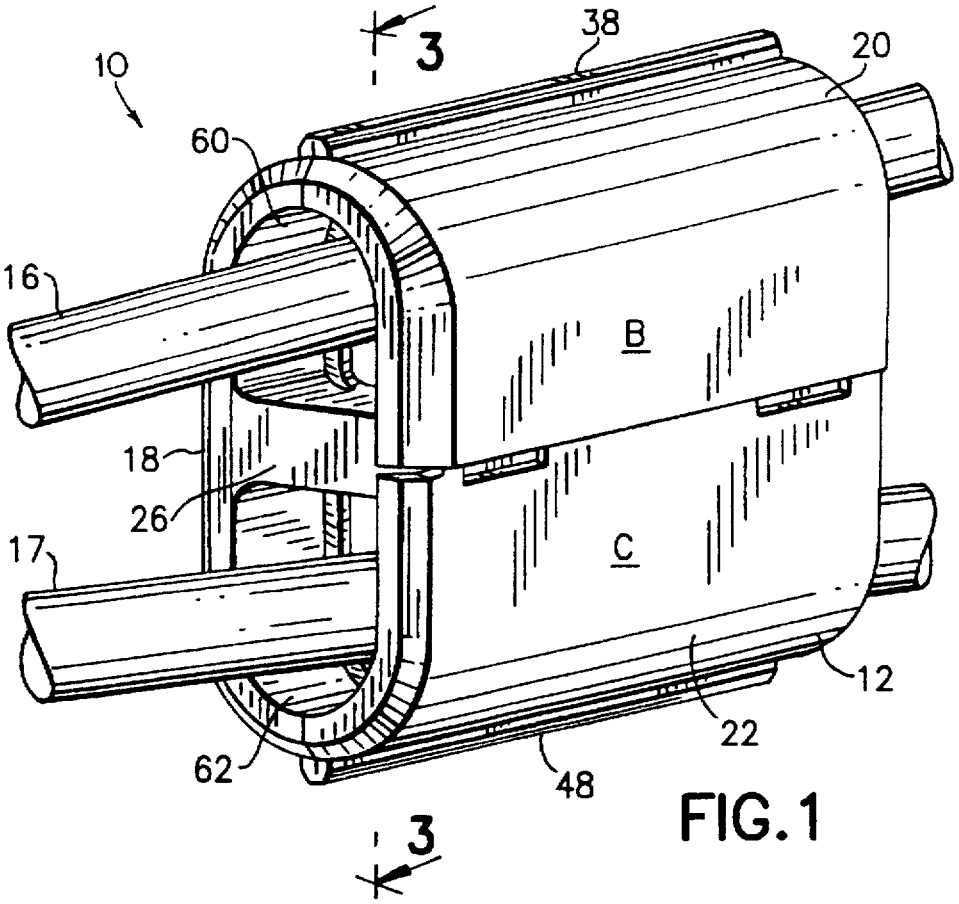
FIG. 1 is a perspective view of a cover incorporating features of the present invention attached to a wedge connector and conductor assembly.

Referring to FIG. 1 there is a shown a perspective view of an assembly 10 having a cover 12 incorporating features of the present invention. Although the present invention will be described with reference to the single embodiment shown in the drawings, it should be understood that the present invention could be embodied in many different types of alternate embodiments. In addition, any suitable size, shape or type of elements or materials could be used.

Figure 3:
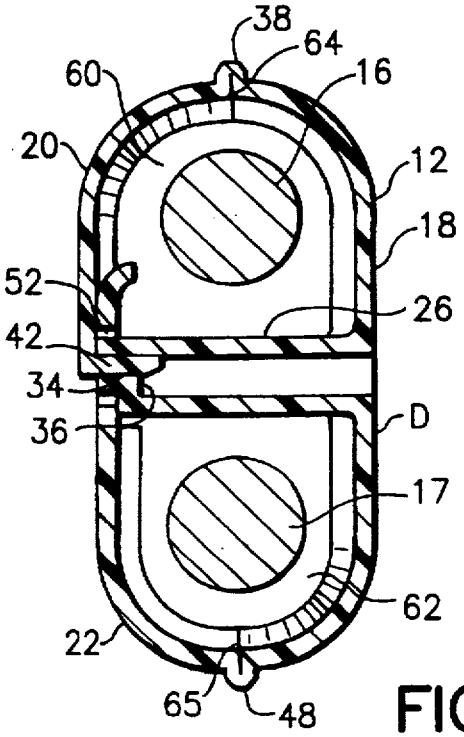
FIG. 3 is a cross-sectional view of the assembly shown in FIG. 1 taken along line 3—3.
Figure 2:
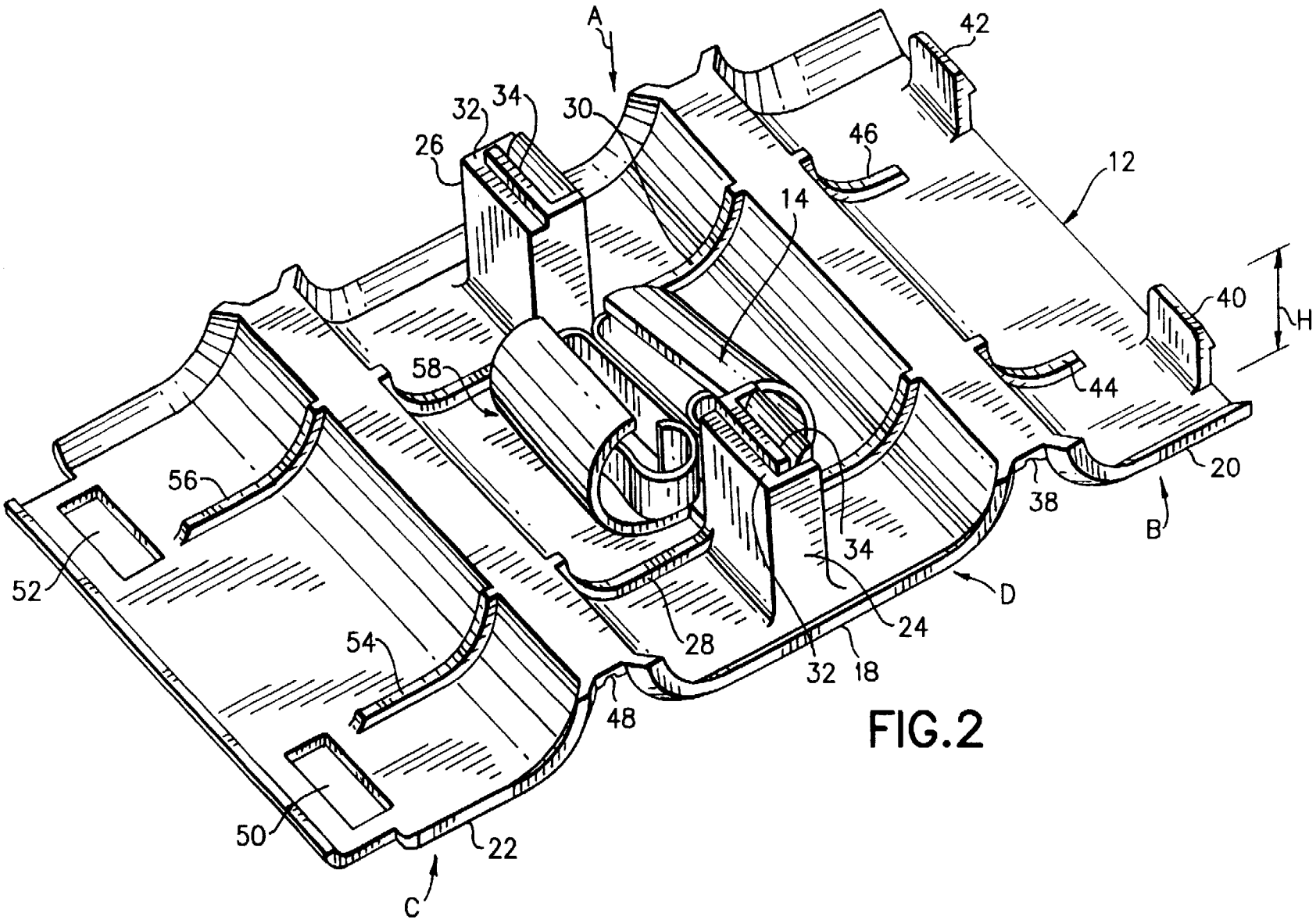
FIG. 2 is a perspective view of the cover shown in FIG. 1 in an open position with an electrical wedge connector located in the holding area.

Electrical wedge connectors are well known in the art, such as is seen in U. S. Pat. No. 5,507,671, which is hereby incorporated by reference in its entirety. Referring also to FIGS. 2 and 3, the assembly 10 has a wedge connector 14 and two electrical conductors 16, 17. The wedge connector 14 electrically and mechanically connects the electrical conductors 16, 17 to each other. The conductors are not shown in FIG. 2 for the sake of clarity only.

The cover 12 is preferably a one-piece member made of an electrically insulating molded polymer or plastic material. The cover 12 includes a base section 18 and two flap sections 20, 22. The base section 18 includes two posts 24, 26, and ribs 28, 30. The posts 24, 26 each have a top with a seat 32 and a hole 34. A snap-lock ledge 36 is located in each of the holes 34. The two posts 24, 26 are located at opposite ends of the base section 18. The first flap section 20 is pivotably attached on one side of the base section by a first hinge section 38. The first flap section 20 includes two snap-lock latches 40, 42 and rib sections 44, 46. The second flap section 22 is pivotably attached on an opposite side of the base section by a second hinge section 48. The second flap section 22 includes two holes 50, 52 and two rib sections 54, 56. The ribs 28, 30, 44, 46, 54, 56 and the posts 24, 26 help to define a wedge connector holding area 58 between the base section 18 and the two flap sections 20, 22.

FIGS. 1 and 3 show the two flap sections 20, 22 in a closed position relative to the base section 18. In this closed position, the second flap section 22 has been pivoted in a reverse direction relative to the first flap section 20 and is seated on the seats 32 of the two posts 24, 26. Portions of the posts 24, 26 extend into the holes 50, 52. The latches 40, 42 on the first flap section 20 extend through the holes 50, 52 of the second flap section 22 and into the holes 34 of the posts 24, 26. The latches 40, 42 make a snap-lock attachment with the snap-lock ledges 36 inside the holes 34. This stationarily fixes the ends of the two flap sections 20, 22 to each other and to the base section 18 at the tops of the posts 24, 26.

In the closed and latched position, the posts 24, 26 extend across the entire width of the holding area 58 at the front and rear ends of the holding area. Two conductor passageways 60, 62 are established on opposite sides of each post 24, 26. The passageways 60, 62 are large enough to allow the conductors 16, 17 to pass therethrough, but too small for the wedge connector 14 to pass through. Thus, the posts 24, 26 prevent the wedge connector 14 from being pulled out of either end of the cover 12. In alternate embodiments other shapes or numbers of posts could be provided. The posts need not span the entire width of the holding area, merely enough to prevent withdrawal of the connector. The flap sections need not connect to the posts. They could merely attach to each other to enclose the holding area. The cover could be comprised of merely one flap section, more than two flap sections, or the flap sections could be connected to the base section in series. Each of the posts could also be formed as two mating post sections; each post having one post section on the base section and one post section on a flap section. The posts could be integrally formed on a flap section rather than the base section.

As seen in FIG. 3, when the hinge sections 38, 48 are bent, they form seams 64, 65. These seams 64, 65 function as drain channels to allow water to drain out of the cover for both situations when the cover is orientated with the first hinge section at the bottom or when the second hinge section is at the bottom. Because of the posts 24, 26, the cover 12 can be used with more different size wedge connectors than prior art covers. Only two sizes of the cover 12 are needed to cover seven different size wedge connectors, whereas at least four different size old type covers were needed in the prior art to cover the same seven sizes of wedge connectors. Thus, the configuration of the cover 12 will reduce inventory. The configuration of the cover 12 will also reduce manufacturing cost because only two molding dies sets are required rather than four as in the prior art. In another alternate embodiment, one or both of the flaps could be adjustably connected to the posts to make the wedge connector holding area smaller or larger for different size wedge connectors.

The configuration of the cover 12 also speeds up molding of the cover. The mold for the cover 12 requires a very minimal shut height/stroke length because the height H is so small. Thus, more strokes can be performed in a given time period than in the prior art. In addition, the largest exterior surfaces B, C and D of the cover are orientated in the molding direction A which allows more functional surface for molding in marking information on the cover.

Figure 4A:
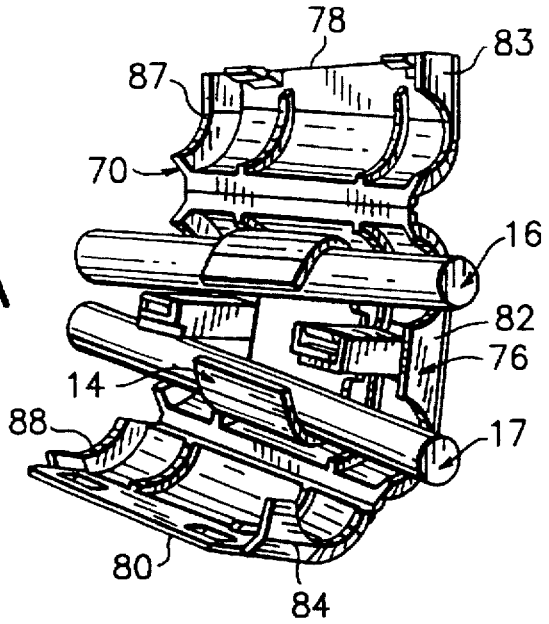
FIG. 4A–4C are perspective views of an alternate embodiment of the present invention.
Figure 4B:
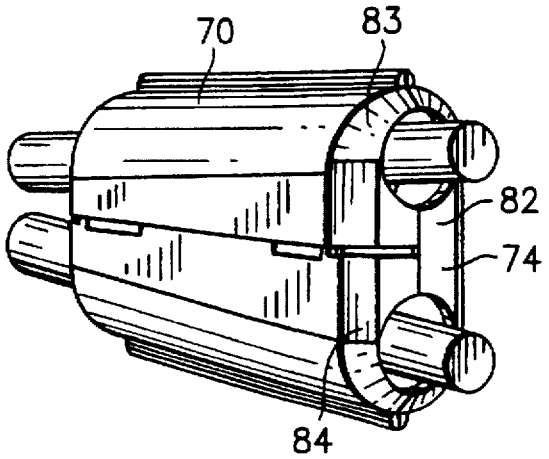
Figure 4C:
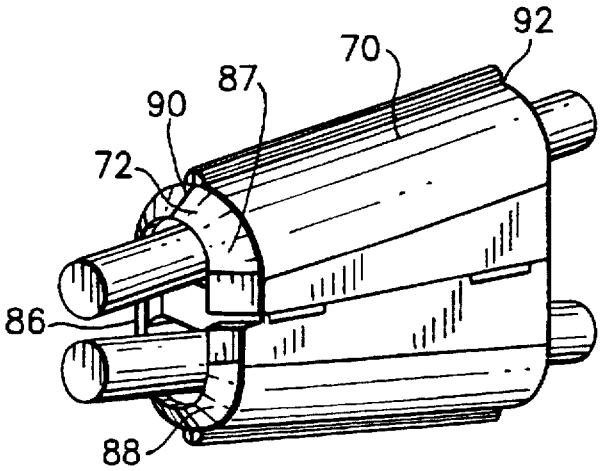

Referring now to FIGS. 4A–4C, an alternate embodiment of the present invention is shown. In this embodiment the cover 70 is similar to the cover 12 shown in FIGS. 1–3 with two exceptions. First, the cover 70 has front and rear shields 72, 74. Second, the cover 70 has a general tapered or wedge shape when closed. The base section 76 and two flap sections 78,80 have rear end shield fins 82, 83, 84 that form the rear shield 74 when the cover is closed. They also have front end shield fins 86, 87, 88 that form the front shield 72 when the cover is closed. The shields 72, 74 help to prevent a user from inadvertently touching exposed conductors inside the cover and help to deter foreign material, such as water, from entering the cover 70. The front end 90 of the cover 70 has a smaller height than the rear end 92. This provides a wedge shape to the cover 70 for making a closer fit with the tapered connector 14. In alternate embodiments, other types of end shields could be provided. In addition, the overall shape of the cover in the closed position could have any suitable shape.

Figure 5:
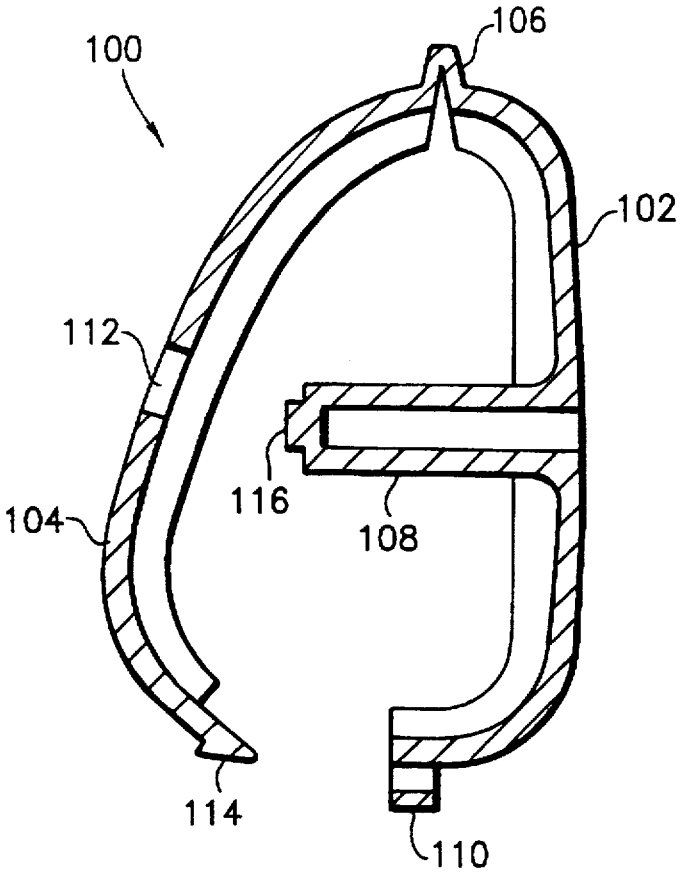
FIG. 5 is a cross-sectional view of another alternate embodiment of the present invention.

Referring now to FIG. 5, another alternate embodiment of a cover is shown. In this embodiment the cover 100 has a base section 102 and one flap section 104 connected by a single hinge section 106. The base section 102 has a post 108 and a snap-lock section 110. The flap 104 has a hole 112 and a snap-lock section 114. Thus, a hinge is provided at one side of the two sections 102, 104, and latches are provided on the opposite sides. The two snap-lock sections 110 and 114 can mate to retain the cover in a closed position. The post 108 has a top section 116 that can be matingly received in the hole 112 without a latching engagement to form a structural span between the base section 102 and the flap section 104 with open areas on opposite sides of the post 108 for conductors to pass. In alternate embodiments, other configurations could be provided.

It should be understood that the foregoing description is only illustrative of the invention. Various alternatives and modifications can be devised by those skilled in the art without departing from the present invention. Accordingly, the present invention is intended to embrace all such alternatives, modifications and variances which fall within the scope of the appended claims.

What is claimed is:

1. An electrical wedge connector cover comprising:

a first section having a first post; and a second section moveably attached to the first section, wherein the first and second sections have a closed position to form a wedge connector holding area therebetween, a width being defined at the holding area between the first and second sections, the post extending substantially across the entire width of the holding area at a first end of the holding area to prevent withdrawal of the wedge connector out of the cover through the first end and allow electrical conductors to pass out of the cover on opposite sides of the post.

2. A cover as in claim 1 wherein the cover is a one-piece member made of an electrically insulating plastic material.

3. A cover as in claim 2 wherein the second section comprises two flap sections pivotably connected on opposite sides of the first section.

4. A cover as in claim 3 wherein a first one of the flap sections has a snap-lock projection, a second one of the flap sections has a hole, and the snap-lock projection extends through the hole and is snap-lock connected to the post in the closed position.

5. A cover as in claim 1 wherein the first section has a second post at a second opposite end of the holding area.

6. A cover as in claim 1 wherein the post extends an entire span width between the first and second sections.

7. A cover as in claim 1 wherein the post has a receiving hole and the second section has a latch that projects into the receiving hole in the closed position to lock the first and second sections in the closed position.

8. A cover as in claim 1 further comprising inwardly projecting ribs at opposite ends of the holding area.

9. An electrical wedge connector cover comprising:

a base section;

a first flap section connected to the base section by a first hinge section; and a second flap section connected to the base section at an opposite side relative to the first flap section by a second hinge section, wherein the first and second flap sections are pivoted in reverse directions over the base section and the first and second flap sections are connected to each other to form a wedge connector holding area; and wherein the base section has a first post at a first end of the wedge connector holding area that forms two conductor passage areas on opposite sides of the post.

10. A cover as in claim 9 wherein the first flap section has a latch that projects into a hole of the second flap section.

11. A cover as in claim 10 wherein an integral post projects away from the base section, and wherein the latch selectively releasably engages the post.

12. A cover as in claim 9 wherein the post extends to the first and second flap sections.

13. A cover as in claim 9 wherein the base section has a second post at a second end of the wedge connector holding area.

14. A cover as in claim 9 wherein a latch on the first flap section projects into a hole in the post.

15. A cover as in claim 9 wherein the first post projects toward the first and second flap sections when the first and second flap sections are pivoted about the first and second hinge sections, respectively, so as to overlie the base section.

16. An electrical wedge connector cover comprising:

a base section having two posts; and a first flap section movably attached to the base section, the flap section having two snap-lock latches, wherein, when the flap section is moved to a closed position to form a wedge connector holding area with the base section, the snap-lock latches attach to the posts to stationarily locate the flap section with the base section, and wherein the posts span the width of the holding area at opposite ends of the holding area to prevent the wedge connector from being withdrawn from the cover; a width being defined at the holding area as the distance between the base section and the flap section when the flap section is in the closed position.

17. A cover as in claim 16 further comprising a second flap section hinged to the base section on an opposite side of the base section from the first flap section.

18. A cover as in claim 16 wherein two conductor passage areas are formed on opposite sides of each post.

* * * * *